United States Patent [19]

Amador

[11] 3,993,159

[45] Nov. 23, 1976

[54] MUFFLER FOR A GOVERNED PNEUMATIC TOOL

[75] Inventor: German Amador, Houston, Tex.

[73] Assignee: Dresser Industries, Inc., Dallas, Tex.

[22] Filed: Jan. 6, 1975

[21] Appl. No.: 538,989

[52] U.S. Cl. ..... 181/36 A; 181/59

[51] Int. Cl.[2] ..... F01N 3/06

[58] Field of Search ..... 181/36 R, 36 A, 49, 181/63, 59, 48

[56] References Cited

UNITED STATES PATENTS

| | | | |
|---|---|---|---|
| 1,547,601 | 7/1925 | Maxim | 181/36 A |
| 2,643,731 | 6/1953 | Schmid | 181/36 A |
| 2,787,251 | 4/1957 | Becker | 181/36 A |
| 3,275,238 | 9/1966 | Nilles | 181/36 A |
| 3,330,378 | 7/1967 | Waldron | 181/36 A |
| 3,459,275 | 8/1969 | Prilwitz | 181/36 A |
| 3,599,756 | 8/1971 | Pickle | 181/36 A |

FOREIGN PATENTS OR APPLICATIONS

| | | | |
|---|---|---|---|
| 460,224 | 11/1950 | Italy | 181/36 A |
| 356,864 | 9/1931 | United Kingdom | 181/36 A |

*Primary Examiner*—L. T. Hix
*Assistant Examiner*—Vit W. Miska
*Attorney, Agent, or Firm*—Roy L. Van Winkle; John N. Hazelwood; Daniel Rubin

[57] ABSTRACT

A muffler for reducing the noise level of the air exhaust from a governed pneumatic tool. Exhaust ports in the tool housing communicate with the interior cavity of a muffler body having selectively located port holes for discharging exhaust from the cavity to atmosphere. Contained in the muffler cavity is a foraminous baffle plate centrally supported in the path of discharge between the exhaust ports of the housing and the discharge ports of the muffler body. Extending about the baffle periphery are a plurality of bypass passages defining a flow path parallel to the baffle and sized to accommodate total air flow at maximum capacity.

7 Claims, 4 Drawing Figures

MUFFLER FOR A GOVERNED PNEUMATIC TOOL

BACKGROUND OF THE INVENTION

The field of art to which the invention pertains includes the art of acoustics and particularly to mufflers for noise level reduction from the exhaust of rotary-type pneumatic hand tools.

By and large, the majority of commercially available pneumatic hand tools include a muffler of sorts for maintaining the noise level of the air exhaust within tolerable limits. Having to tolerate too high a noise level for any period of time can have a deleterious effect on the workman operating the tool. With the advent of OSHA (Occupational Safety and Health Administration) Federal regulations now impose even stricter standards for such tools than have existed previously rendering the objective of increased muffling not only a basic comfort but a legal requirement. As set forth in the Federal Register, Vol. 39, No. 125 of June 27, 1974, Table G-16 establishes the daily work duration at 8 hours with a noise level of 90 dBA and only 4 hours with a noise level of 95 dBA further decreasing to only 1 hour at a noise level of 105 dBA.

In any pneumatic tool, expansion of the inlet air from a high pressure at the intake to low pressure at the exhaust causes a drop in temperature to occur such that moisture present in the air stream tends to freeze and create an iced over condition on the surfaces over which it passes. For ungoverned pneumatic tools, the icing tendency is minimal and it is customary to employ sound absorbing compositions for the muffler such as cintered metal, metal wool, felt, screen wire, etc. located in the exhaust passage for absorbing noise from the exhausting air before being discharged to atmosphere. With governed pneumatic tools utilizing a governor to maintain control over output speed, the air quantity varies with load and for which such compositions are generally unsuitable because of the greater tendency toward icing of moisture content. Where icing occurs in these tools, it tends to clog or partially block the interstices of the muffler composition reducing flow capacity and inhibiting tool performance. For that reason, governed pneumatic tools typically employ a muffler formed of large cavities which function as a resonator. While effecting and meeting the objective of noise reduction, the resonator type muffler unfortunately contributes significant added size and weight which essentially prohibits their use on a portable-type hand tool. Despite recognition of the problem, a ready solution has not heretofore been known.

SUMMARY OF THE INVENTION

The invention relates to an improved muffler device for governed pneumatic hand tools. More specifically, the invention relates to an inexpensive muffler construction utilizing minimal consumption of space and contributing a minimum of weight yet able to maintain muffling effect and tool performance even in the face of icing conditions which has plagued such similar purpose mufflers in the past. This is achieved in accordance herewith by utilizing a ported muffler body of cup shape forming an enclosed cavity about the exhaust ports in the tool housing. A thin foraminous baffle plate is contained in the muffler cavity centrally supported in the path of discharge from the tool housing exhaust to the outlet ports of the muffler body. A bypass passage of predetermined flow capacity between the baffle periphery and the body wall surface provides a parallel and tortuous flow path therebetween able to maintain flow capacity and sound absorption despite any ice choking as may occur on the baffle.

It is therefore an object of the invention to provide a novel muffler construction for governed pneumatic tools.

It is a further object of the invention to provide a novel muffler of relatively compact design able to continue functioning even in the face of ice choking in and about surfaces of the muffler components.

It is a still further object of the invention to effect the foregoing objects with a construction that is compatible with the size and weight requirements of a portable hand tool as not to significantly detract from the hand held operation thereof.

It is a still further object of the invention to effect the foregoing objects with a relatively uncostly construction as not to place such tools at an economic disadvantage as compared to other tools with which it commercially competes.

Figure 1:
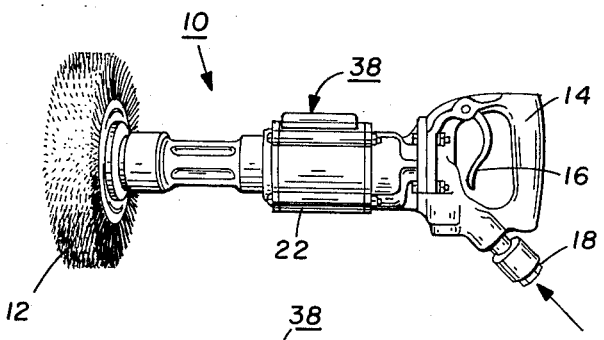
FIG. 1 is a pictorial illustration of a hand portable pneumatically operable wire brush.
Figure 2:
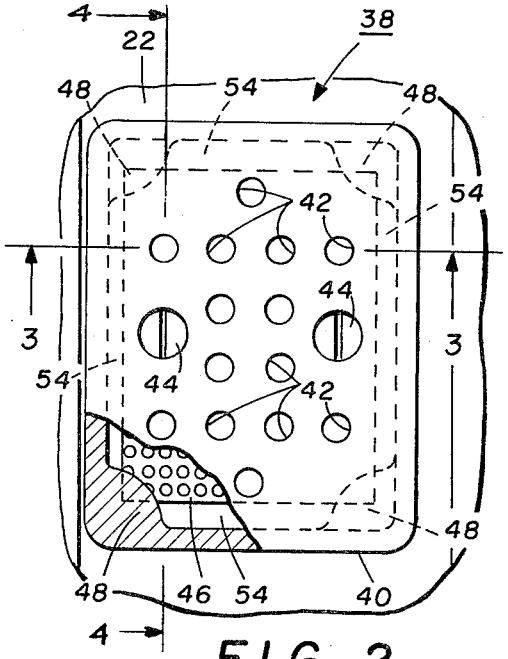
FIG. 2 is a plan view looking at the topside of the muffler.
Figure 3:
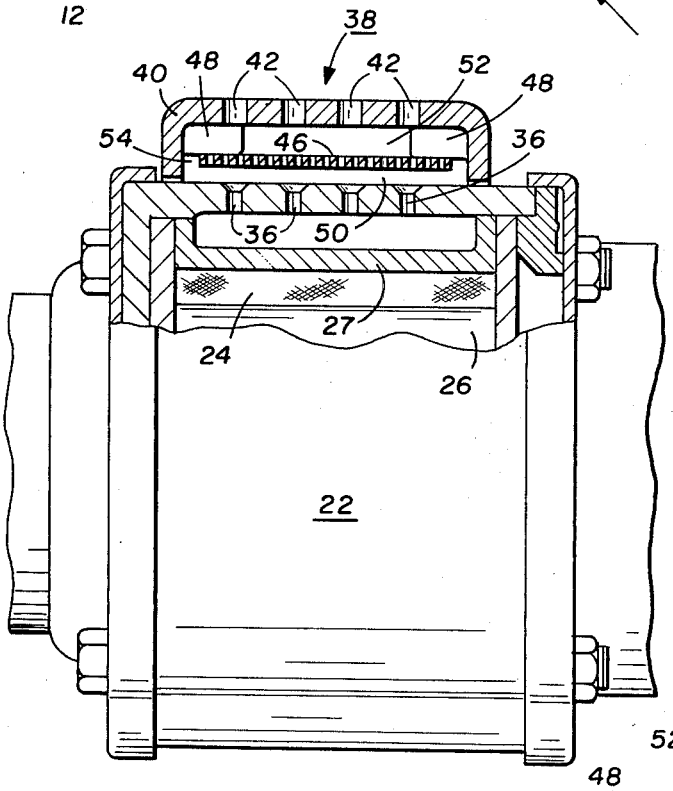
FIG. 3 is an elevation partially sectioned along the lines 3—3 of FIG. 2.
Figure 4:
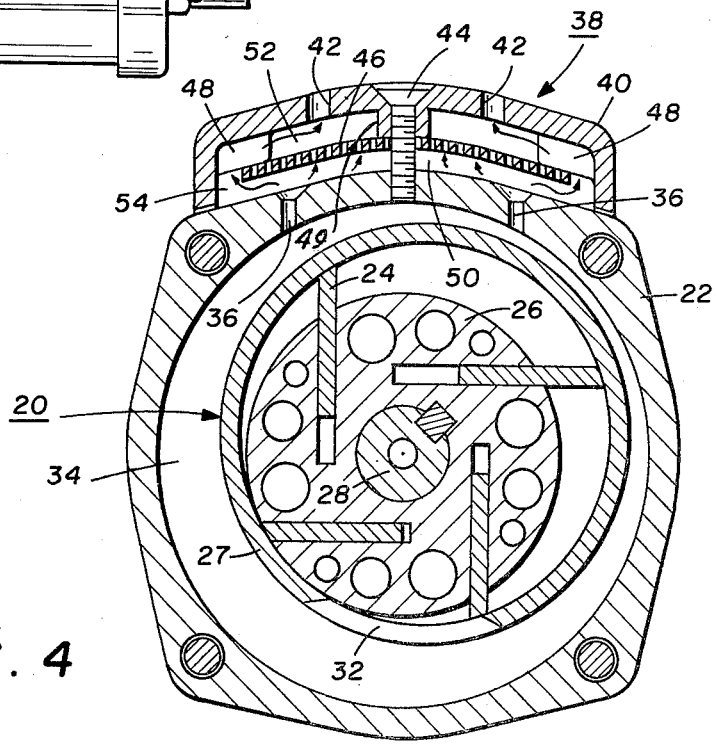
FIG. 4 is a sectional elevation taken substantially along the lines 4—4 of FIG. 2.

Referring now to the drawings, there is shown in FIG. 1 an exemplary portable type pneumatic tool 10 for high speed rotation of a grinding wheel or wire brush 12. Comprising the tool is a handle grip 14 containing a finger trigger 16 whereby the operator can control the supply of air from an inlet 18 to an air-motor 20 contained in housing 22. Motor 20 operates in a conventional manner in response to high pressure inlet air reacting against vanes 24 for rotating rotor 26 relative to stator 27. A drive shaft 28 on which brush 12 is supported is connected to rotor 26. Spent air from the motor is exhausted through a primary exhaust outlet (not shown) and a secondary exhaust outlet 32, both of which discharge into exhaust passage 34. For further discharging the relatively low pressure exhaust air from passage 34 there is provided a plurality of apertures or ports 36 on the top side of housing 22. Included in the inlet air stream ahead of motor 20 for the type of tool under consideration is a suitable governor (not shown) for regulating and maintaining tool speed in response to variations in load. The governor may, for example, comprise a type disclosed in U.S. Pat. No. 3,749,530.

Comprising muffler 38 for reducing the noise level of exhaust discharging through apertures 36 is a generally cup shaped body 40 having a plurality of apertures 42 in its top wall. Body 40 can be formed of any suitable plastic or metal composition such as sand cast aluminum and is adapted to be secured to tool housing 22 by means of screws 44 whereby to form an internally enclosed cavity extending about tool apertures 36. Contained at an intermediate location in the path of discharge within the body cavity is a foraminous baffle plate 46 centrally supported by screws 44 against the underside of corner pads 48 and screw hole pads 49 as to define a parallel cavity 50 at its underside and a parallel cavity 52 on its top side. Baffle plate 46 can be of any suitable foraminous composition and in a preferred form is thin brass screen stock of 0.045 inch diameter holes — 233 holes per square inch affording 35 to 40 percent open area to accommodate 100 percent of total flow capacity discharging through apertures 36.

Cooperating with baffle plate 46 defined between the four sides thereof and the inside face of body 40 are a plurality of parallel flow bypass passages 54 enabling exhaust air entering cavity 50 to either flow through the baffle or to bypass the baffle in a parallel path toward cavity 52. Under normal conditions, the division of flow is self distributing as a function of pressure drop. For reasons hereof, the total combined flow area provided by passages 54 are likewise sized to accommodate 100 percent of full load flow consumption anticipated with in-service operation of the tool.

In operation, exhaust air discharging through exhaust ports 36 first enters muffler cavity 50. At that point, the flow is divided between that which impinges and passes through baffle plate 46 for diffusing some of its energy and that which flows in a more tortuous path along the baffle underface until passing parallel past the baffle through passages 54. Both air flows are then merged in upper cavity 52 before being discharged to atmosphere via body ports 42. By means of the tortuous flow path and the impingement encountered against and through baffle plate 46, the sound level of the exhaust is able to be reduced from an unmuffled condition of about 91 dBA to about 84 dBA as to represent a 400 percent reduction in sound power. Should any moisture in the air stream freeze to form ice particles in and about the baffle plate tending to choke flow capacity thereof from extended maximum horsepower operation, the sizing of cavities 50 and 52 in conjunction with the size of bypass passages 54 are sufficient to maintain tool operation. Even under those conditions with total air flow bypassing baffle plate 46, the noise level increases slightly to under 90. This, however, is only temporary because of the rapid melting of ice when the tool regains free speed or stops.

By the above description there has been disclosed a novel muffler construction for a governed pneumatic motor. The muffler represents the height of simplicity for tools of that type able to achieve a substantial noise reduction in the exhaust air without significantly adding to the weight or size of the tool per se. By virtue of its simplicity, cost of the muffler is relatively minimal enabling it to be widely used without any significant cost increases as to not adversely affect the economics of construction, the latter of which represents an extremely important factor in these highly competitive tools.

Since many changes could be made in the above construction and many apparently widely different embodiments of this invention could be made without departing from the scope thereof, it is intended that all matter contained in the drawings and specification should be interpreted as illustrative and not in a limiting sense.

The embodiments of the invention in which an exclusive property or privilege is claimed are defined as follows:

1. In a speed governed pneumatic tool including an air motor, an inlet for receiving a supply of pressurized air for operating said motor, and an outlet for discharging air exhausted by said motor, a muffler for reducing the sound level of said exhaust air and comprising:

a. a body having discharge apertures selectively located in a wall thereof and forming an inward cavity substantially enclosing said outlet;

b. a foraminous baffle plate supported in said cavity at an intermediate location in the path of air discharge between said outlet and said body apertures; and c. a bypass passage defined extending operatively parallel with said baffle plate for bypassing at least a predetermined minimum percentage of total air flow being discharged through said outlet, said bypass is located between at least a peripheral edge portion of said baffle plate and the internal body wall surface thereat.

2. In a pneumatic tool according to claim 1 in which the flow capacity of said bypass substantially approximates the flow capacity of said baffle plate.

3. In a pneumatic tool according to claim 2 in which said bypass includes a flow capacity at least substantially corresponding to full load air flow of said tool.

4. In a pneumatic tool according to claim 3 in which said discharge outlet is comprised of a plurality of spaced apertures in a wall of said tool extending in a plane generally parallel to the wall of said body containing said body apertures and said baffle plate is substantially supported centrally located with respect to the apertures in both of said walls as to be superposed to said tool wall and subtending said body wall.

5. In a pneumatic tool according to claim 3 in which said baffle plate is comprised of screen stock having about 35 to 40 percent open area.

6. In a pneumatic tool according to claim 5 in which said baffle plate is of substantially rectangular configuration and a portion of said bypass is located along each side edge of said baffle plate.

7. In a pneumatic tool according to claim 6 in which said discharge outlet is comprised of a plurality of spaced apertures in a wall of said tool extending generally parallel to the apertures in said body wall with both of said wall apertures being at locations alignably corresponding to within the edge limits of said baffle plate.

* * * * *